US007185599B1

(12) United States Patent
Griffiths et al.

(10) Patent No.: US 7,185,599 B1
(45) Date of Patent: Mar. 6, 2007

(54) JET DRIVE PROPULSION SYSTEM FOR A PONTOON BOAT

(75) Inventors: John M. Griffiths, Fond du Lac, WI (US); Wayne M. Jaszewski, Jackson, WI (US); George E. Phillips, Oshkosh, WI (US); Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/328,641

(22) Filed: Jan. 10, 2006

(51) Int. Cl.
*B63B 21/56* (2006.01)

(52) U.S. Cl. ..... 114/248; 114/263; 440/111

(58) Field of Classification Search ..... 114/61.1, 114/246, 248, 249, 250, 251, 252, 263, 291; 440/38, 49, 52, 53, 111
See application file for complete search history.

(56) References Cited

U.S. PATENT DOCUMENTS

| | | | | | |
|---|---|---|---|---|---|
| 3,347,201 | A | * | 10/1967 | Szabo | 114/248 |
| 3,659,546 | A | | 5/1972 | Miklos | 114/235 R |
| 3,815,541 | A | * | 6/1974 | Hansen | 114/248 |
| 4,051,801 | A | | 10/1977 | Woodfill et al. | 115/12 R |
| 5,184,561 | A | | 2/1993 | Nickell, Jr. | 114/61 |
| 5,259,331 | A | | 11/1993 | Hagan | 114/61 |
| 5,353,730 | A | * | 10/1994 | Talbot | 114/248 |
| 5,435,260 | A | | 7/1995 | Granie et al. | 114/61 |
| 5,540,174 | A | * | 7/1996 | Kishi et al. | 114/291 |
| 5,605,110 | A | * | 2/1997 | Talbot | 114/248 |
| 5,645,007 | A | * | 7/1997 | Benton | 114/263 |
| 5,759,074 | A | | 6/1998 | Jones | 440/38 |
| 5,879,209 | A | | 3/1999 | Jones | 440/42 |
| 5,911,187 | A | | 6/1999 | Sohm | 114/61 |
| 5,967,868 | A | * | 10/1999 | Ito et al. | 440/111 |
| D416,852 | S | | 11/1999 | Clarke | D12/310 |
| 6,016,762 | A | | 1/2000 | Price | 114/274 |
| 6,386,931 | B1 | * | 5/2002 | Nanami | 440/111 |
| 6,454,620 | B1 | | 9/2002 | Theisen et al. | 440/61 |
| 6,477,969 | B2 | | 11/2002 | Schell-Tomczak et al. | 114/61.1 |
| 6,482,056 | B1 | | 11/2002 | Schell-Tomczak et al. | 440/53 |
| 6,708,642 | B1 | | 3/2004 | Taylor | 114/290 |
| 6,939,184 | B2 | | 9/2005 | Fishburn et al. | 440/52 |
| 2004/0255836 | A1 | | 12/2004 | Hopkins | 114/347 |

* cited by examiner

*Primary Examiner*—Lars A. Olson
(74) *Attorney, Agent, or Firm*—William D. Lanyi

(57) ABSTRACT

A pontoon boat is provided with a jet drive propulsion system in which an impeller is driven by an engine. The jet drive propulsion device is dirigible as a result of the fact that a nozzle of the device is rotatable about a generally vertical steering axis. The jet drive device can be supported below a deck of a pontoon boat and located between two flotation tubes of the pontoon boat. Alternative locations can also be used, such as within the structure of the flotation tubes themselves.

29 Claims, 11 Drawing Sheets

JET DRIVE PROPULSION SYSTEM FOR A PONTOON BOAT

BACKGROUND OF THE INVENTION

1. Field of the Invention

The present invention is generally related to marine propulsion systems for a pontoon boat and, more particularly, to a jet drive propulsion system for a pontoon boat.

2. Description of the Related Art

Those skilled in the art of marine propulsion systems are aware of many different types and styles of pontoon boats. As used herein, the term "pontoon boat" shall mean a marine vessel which supports a deck surface on flotation devices. The flotation devices, in a typical application of a pontoon boat, are hollow or foam-filled tubes that are arranged in generally parallel relation with each other. The deck, or platform, of the pontoon boat extends across the upper portions of the flotation tubes. In most applications, a majority of the deck surface is a flat horizontal plane.

In a typical application, a pontoon boat is provided with an outboard motor that is attached to a rear portion of the support structure of the vessel. In some applications, the outboard motor can be provided with a jet pump attached to a lower portion of a driveshaft housing of the outboard motor. In other applications, not involving a jet pump, the outboard motor is typically provided with a conventional propeller that is supported for rotation by a gear case located at the bottom portion of the driveshaft housing. In jet pump applications, the gear case is replaced with a jet pump having an impeller.

Those skilled in the art of marine propulsion systems used in conjunction with pontoon boats are familiar with a detachable container, or pod, that can be fastened beneath the deck of the pontoon boat and provided with an inboard marine drive. In those types of applications, one or more propeller shafts extend rearwardly through the container and are, driven by an engine located within the cavity provided by the container. In addition, certain applications of removably attachable containers used with pontoon boats can incorporate a sterndrive propulsion device.

Known marine propulsion devices of the type described immediately above do not provide a sterndrive or jet drive propulsion device within a container that permits the entire engine and drive to be disposed completely below the upper surface of the deck that extends between flotation tubes. In known applications, a portion of the marine propulsion system, such as the engine, extends upwardly through the plane of the upper surface of the deck of the pontoon boat.

U.S. Pat. No. 3,659,546, which issued to Miklos on May 2, 1972, describes a motor boat propelled pontoon boat. It relates to pontoon boats which normally carry a dingy for transporting the passengers to and from the pontoon boat. The stern end of the pontoon boat is provided with a novel structure for incapsulating a motor boat which provides the motive means to propel the pontoon boat. It combines the motor boat and pontoon boat to form an integral structure for purposes of propulsion of both crafts. Both crafts are separable when it is desired to use the motor boat as a tender craft.

U.S. Pat. No. 4,051,801, which issued to Woodfill et al. on Oct. 4, 1977, describes a drive position signaling apparatus. A marine jet drive unit includes a nozzle which is mounted in a gimbal ring for pivoting about a horizontal axis for trimming of the drive jet. An electric motor drives a gear train including a rotating actuator shaft having an Acme nut actuator connected by a rigid linkage to the gimbal ring for trim positioning of the nozzle.

U.S. Pat. No. 5,184,561, which issued to Nickell on Feb. 9, 1993, describes a planing pontoon boat. The boat comprises elongated flotation units of generally circular cross-section positioned in spaced apart parallel relationship with each of the flotation units having planing fins extending longitudinally of the inboard and outboard sides of the flotation units near the bottom thereof to cause the pontoon boat to readily hydroplane. A wedge-shaped fin is provided on the underside of the outboard planing fins near the bow section to provide additional lift when turning at high speeds to improve control and stability on turns.

U.S. Pat. No. 5,259,331, which issued to Hagan on Nov. 9, 1993, describes a motor pod for a pontoon boat. The pontoon boat is adapted to be propelled by an outboard motor, the boat having a deck and a pair of longitudinally extending parallel spaced apart pontoons depending from the deck and a means for mounting the outboard motor to the boat. The mounting means depends from the deck between the pontoons and comprises a pair of elongated substantially vertical spaced apart side walls having front and aft ends, the side walls becoming deeper and more spaced apart as they extend from their front ends to their aft ends.

U.S. Pat. No. 5,435,260, which issued to Granie et al. on Jul. 25, 1995, describes a pontoon-type boat. It comprises a deck having opposite sides and a modified tunnel hull supporting the deck and including a first outer sponson located adjacent one of the sides of the deck, a second outer sponson located adjacent the other of the sides of the deck and a center sponson which is located and spaced between the outer sponsons, which extend substantially the entire length of the boat, and which includes a rearward portion having a maximum depth and a maximum width, and a forward portion having a maximum width greater than the maximum width of the rearward portion and having a maximum depth greater than the maximum depth of the rearward portion, the forward and rearward portions defining therebetween a step.

U.S. Pat. No. 5,879,209, which issued to Jones on Mar. 9, 1999, discloses an automatic trim control system for a jet propelled watercraft. The system is intended for a marine jet drive and adjusts trim in response to water pressure in the jet drive duct immediately upstream of the impeller. The preferred system includes a mechanical actuator consisting of a spring biased link rod mounted to a resilient diaphragm located in an actuator housing. The disclosed invention is exemplary of jet drive marine propulsion devices and shows one particular configuration of a jet drive system.

U.S. Pat. No. 5,759,074, which issued to Jones on Jun. 2, 1998, discloses an impeller mounting system for a personal watercraft. The mounting system for a jet propelled watercraft uses an impeller shaft having a tapered portion and an impeller hub having a coaxial opening with a corresponding tapered seat. The impeller hub is tightened onto the impeller shaft so that the tapered portion of the impeller shaft presses against the tapered seat of the coaxial opening in the impeller hub with sufficient force to prevent the impeller hub from slipping with respect to the impeller shaft when the impeller shaft rotates to drive the impeller hub. The invention illustrates one embodiment of an impeller that is used with a jet drive propulsion device.

U.S. Pat. No. 5,911,187, which issued to Sohm on Jun. 15, 1999, describes a pontoon boat having a deck disposed over distal, watertight pontoons. Each pontoon comprises an elongated, generally cylindrical shell having a bow end consisting of an eccentric conical section extending upward at an angle out of the water. Splash rails, comprising fins protruding from the pontoon's shell, are disposed along the pontoon's inner and outer surfaces so that they extend substantially from the pontoon's bow end to its stern end.

U.S. Pat. Des. 416,852, which issued to Clarke on Nov. 23, 1999, describes an ornamental design for a boat. The boat is a pontoon boat and includes a center tube supported between two flotation tubes.

U.S. Pat. No. 6,016,762, which issued to Price on Jan. 25, 2000, describes a planing foil for twin hulled boats. The apparatus includes a mounting structure for connecting a planing foil to the boat with the foil positioned between and spaced from the pontoons generally amidships and straddling the transfer centerline of the boat. The foil is also positioned between the waterline and the lower surfaces of the pontoons when the boat is at rest so that the foil rises toward a planing position on the surface of the water as the boat is propelled therealong in order to lift the boat and reduce drag.

U.S. Pat. No. 6,477,969, which issued to Schell-Tomczak et al. on Nov. 12, 2002, describes a boat with a center pontoon and a separate motor mount. The center pontoon provides improved performance and an adjustable engine mount. The adjustable engine mount makes it possible to adjust the relative position of an outboard engine relative to the waterline of the boat. The center pontoon includes a relieved top surface for allowing a vertical adjustment movement of the engine mount. The mount has an elongated, mount body which is adjustably attached to the bottom of the hull of the boat by a pair of spaced apart, elongated mounting rails.

U.S. Pat. No. 6,454,620, which issued to Theisen et al. on Sep. 24, 2002, discloses an integrated external hydraulic trimming and steering system for an extended sterndrive transom assembly. The propulsion system is provided with a drive unit that is attachable to a transom of a marine vessel and provided with steering cylinder assemblies and trimming cylinder assemblies which are connected to a common location on a structural member, such as a gimbal ring. This arrangement improves the geometric relationship between the steering and trimming functions. In addition, the hydraulic steering system is provided with pressure relief valves that are located at the transom of the marine vessel in order to shorten the distance of the hydraulic conduits extending between the pressure relief valves and the steering cylinders.

U.S. Pat. No. 6,482,056, which issued to Schell-Tomczak et al. on Nov. 19, 2002, describes an engine mount for a pontoon boat. The mount makes it possible to adjust the relative position of an outboard engine relative to the waterline of the boat. The mount has an elongated, tapered, four-sided body which is attached to the bottom of the hull of the boat by a pair of spaced apart, elongated mounting rails.

U.S. Pat. No. 6,708,642, which issued to Taylor on Mar. 23, 2004, describes a tri-sponson boat hull and method of making boat hulls. The boat hull has an upper hull section, a pair of spaced apart substantially parallel elongated outer sponsons extending from a forward portion to a stern portion of a bottom of the upper hull section, the outer sponsons and upper hull section defining a tunnel therebetween; and an elongated center sponson extending along the bottom of the upper hull and positioned in the tunnel between and substantially parallel to the pair of outer sponsons and having a forward section with an upwardly extending trailing step wall defining an upward step in the center sponson, and an aft section that is located aft of the forward section, the aft section having an upwardly curved leading edge intersecting the step wall of the forward section. The upper hull section can have a planar bottom.

U.S. Pat. No. 6,939,184, which issued to Fishburn et al. on Sep. 6, 2005, describes an isolated motor pan for a watercraft. A dampening assembly used in watercraft to isolate the motor from the deck of the watercraft is described. In an embodiment of the invention, a frame including cross members and a plurality of brackets supports the deck. The dampening assembly extends from the brackets of the frame to the motor and retains the motor at a position ensuring the motor does not contact the frame. The only path available to the vibrations generated by the motor is represented by the dampening assemblies that direct the vibrations to the brackets and tubes, thereby eliminating the high amplitude, low frequency vibrations that readily transfer through the deck and frame structure.

U.S. patent application Ser. No. 10/856,092, which was filed by Hopkins on May 28, 2004, describes a watercraft. The watercraft comprises a shell having an upper skin adapted to support at least one person, a lower skin defining a hull for contact with the water, an aperture extending through the upper and lower skin and defined by a sidewall enclosure between the lower skin and the upper skin to maintain the integrity of the shell, wherein the aperture removably secures a propulsion means for propelling the watercraft, such that a cavity within the shell remains water tight to allow for practical functioning when the propulsion means is removed.

The patents described above are hereby expressly incorporated by reference in the description of the present invention.

SUMMARY OF THE INVENTION

In a particularly preferred embodiment of the present invention, a marine propulsion system for a pontoon boat comprises a container and an internal combustion engine disposed within the container. A marine propulsion device is connected in torque transmitting relation with the internal combustion engine. The marine propulsion device has a dirigible segment which is supported by the container for rotation about a generally vertical steering axis.

In a preferred embodiment of the present invention, the container is attachable to an underside of a platform of the pontoon boat and the internal combustion engine is disposed below a top surface of that platform.

Various embodiments of the present invention can incorporate jet drive devices, as the marine propulsion device, with a container. Alternate embodiments can incorporate sterndrive devices which are attached for support to the container.

In some embodiments of the present invention, a fuel reservoir can be disposed within the container and connected in fluid communication with the internal combustion engine. Similarly, an electrical storage battery can also be disposed within the container and connected in electrical communication with a starter motor of the internal combustion engine.

In a particularly preferred embodiment of the present invention, the container is removably attached to a platform of the pontoon boat with all components attached to the container being located completely below the upper surface of the platform. Elastomeric components can be used to isolate the container and its constituent components from the platform of the pontoon boat in order to decrease the amount of noise and vibration transmitted from the engine and marine drive device to the platform of the pontoon boat.

Various embodiments of the present invention will be described in detail below. These embodiments incorporate various advantageous characteristics of the present invention in selected combination with each other. One particularly advantageous characteristic is the placement of the engine completely below an upper surface of the deck which extends between flotation tubes of the pontoon boat. A door can be provided in the deck of the pontoon boat to allow easy access to the engine and other components disposed within the container while avoiding the necessity of having a bulge extending upwardly through the top surface of the deck. The engine is disposed within the pod and the marine propulsion device is supported by the pod so that it is rotatable about a generally vertical steering axis. Several embodiments of the present invention allow a container, with its engine and marine propulsion device, to be completely fabricated at a site which is remote from the pontoon boat itself. The completed container, or pod, with its engine and marine propulsion device can then be delivered and attached as a completed unit to the underside of the deck of the pontoon boat. The container, in a preferred embodiment of the present invention, is removably attached to the deck of the pontoon boat so that it can be removed for purposes of repair and other maintenance procedures. The container is intended to be removably attached to the underside of the deck of the pontoon boat at a location which places the actual propulsor, such as a propeller or impeller, forward of a rear portion of the deck. This provides an advantage because it places the propeller at a position which is forward of the rear edge of the deck and farther from locations where swimmers may be in a position that is disadvantageously close to the propeller.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
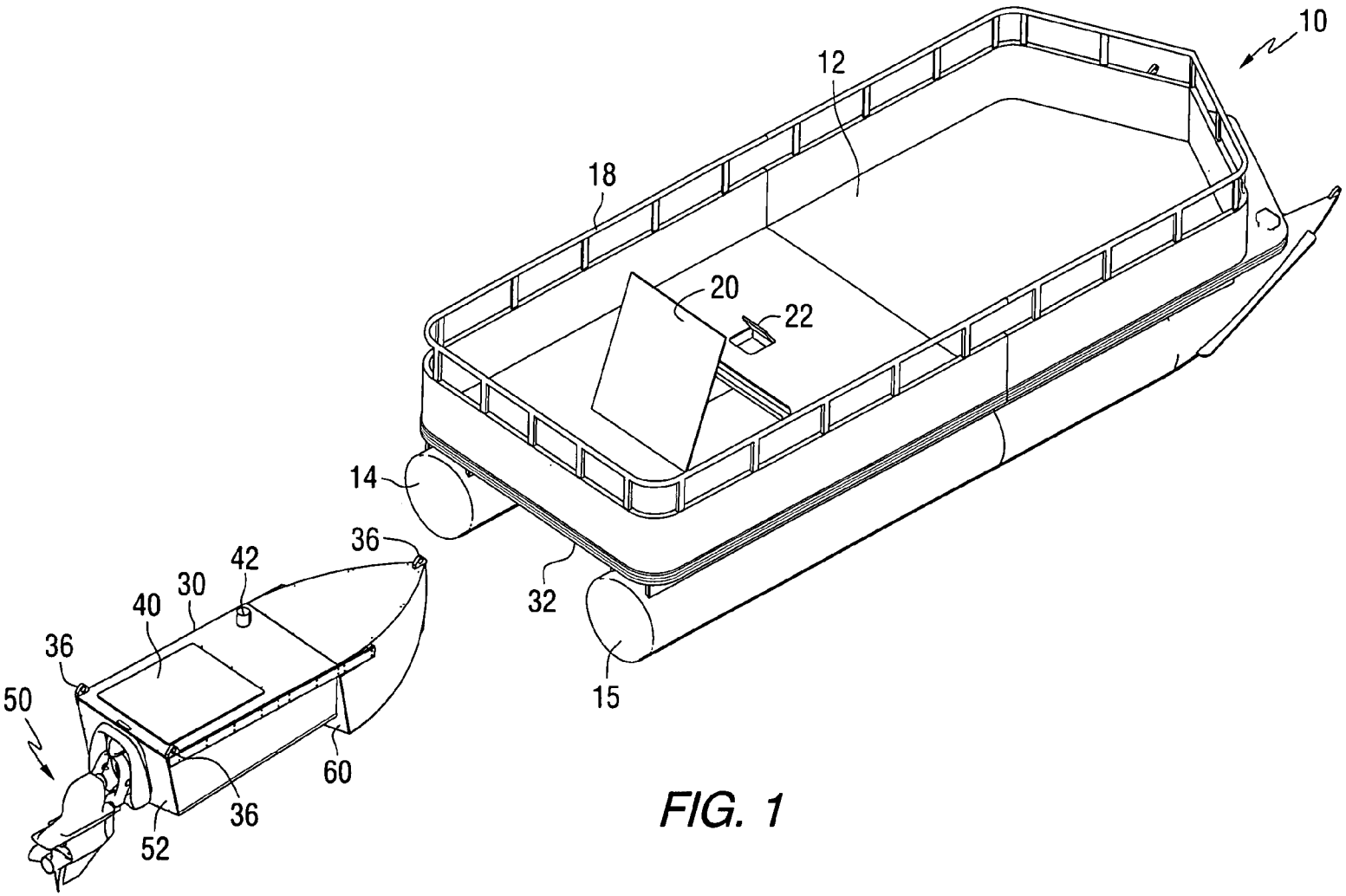
FIG. 1 is an isometric view showing a marine propulsion container spaced apart from a pontoon boat to which it can be removably attached.

Throughout the description of the preferred embodiment of the present invention, like components will be identified by like reference numerals.

FIG. 1 shows a pontoon boat 10 that comprises a deck 12, or platform, supported by two flotation tubes, 14 and 15. The pontoon boat 10 is provided with a railing structure 18. An access door 20 is provided in the generally horizontal and planar surface of the deck 12. In addition, a fuel access door 22 is provided for purposes that will be described in greater detail below.

With continued reference to FIG. 1, a container 30, or pod, is removably attachable to an underside 32 of the pontoon boat 10. This removable attachability can be accomplished through the provision of mounts 36 attached to the container 30 and shaped to cooperate with similarly configured mounts attached to the underside 32 of the deck 12. The container 30 is provided with a container door 40 which allows access to the inner cavity of the container 30 as will be described in greater detail below. A fuel opening 42, or conduit, is also provided to allow fuel to be added to a fuel reservoir within the container 30 through the fuel door 22 in the deck 12 of the pontoon boat 10.

With continued reference to FIG. 1, the container 30 supports a marine propulsion device which is illustrated in FIG. 1 as a sterndrive device 50. The sterndrive device 50 is attached to a rear wall 52 of the container 50 in a manner that is generally similar to the way that a sterndrive device is attached to a transom of a marine vessel. This method of attachment and support of the sterndrive device 50 is well known to those skilled in the art.

Also shown in FIG. 1 is a step 60 formed in the outer surface of the container 30. This step is intended to provide appropriate and advantageous lift to the pontoon boat 10, through the use of hydrodynamic forces, when the pontoon boat is being propelled by the marine propulsion device, such as the sterndrive device 50.

Figure 2:
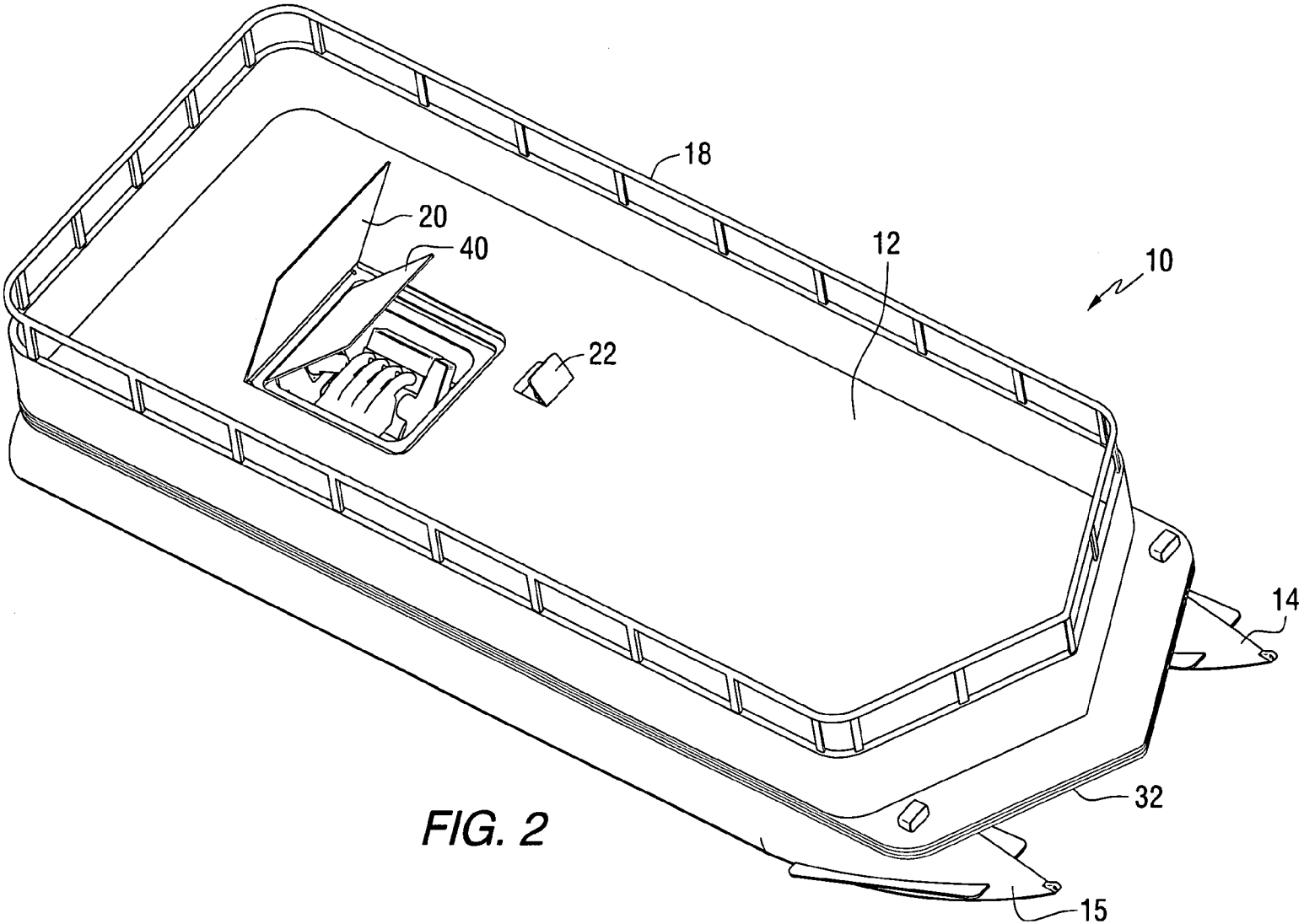
FIG. 2 is an isometric view of a pontoon boat with access doors opened to reveal the location of an internal combustion engine disposed within a container of the present invention.

FIG. 2 shows the pontoon boat 10 with its door 20 of the deck 12 partially opened, to illustrate its operation, and the container door 40 also partially opened. It should be understood that, in a particularly preferred embodiment of the present invention, the closure of the two doors, 20 and 40, results in a flat and unobstructed planar top surface of the deck 12 in the region above the container 30. In other words, one advantage in a preferred embodiment of the present invention is that it requires no bulge which extends upwardly above the plane of the top surface of the deck 12 in the region above the container 30.

Figure 3:
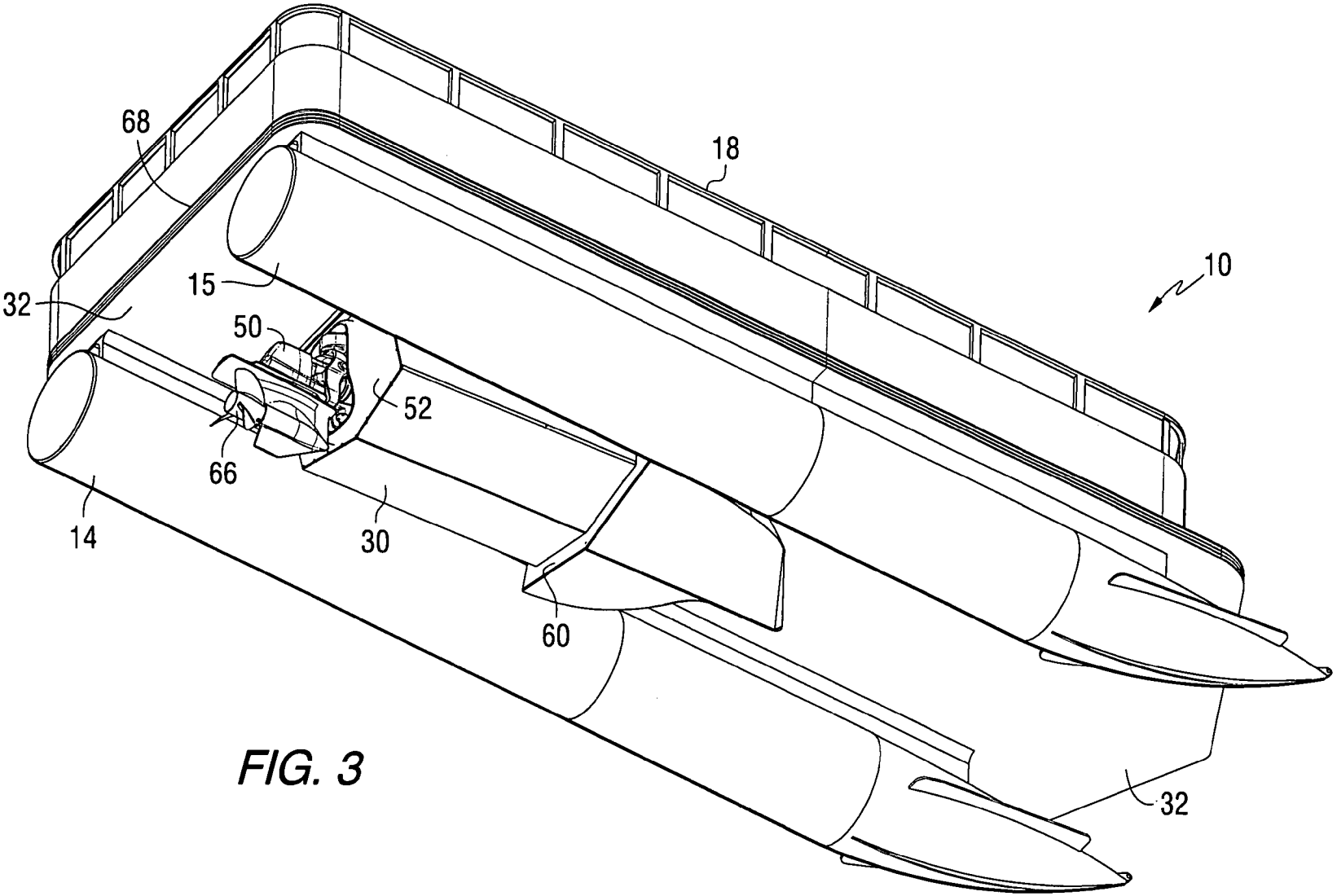
FIG. 3 is a bottom isometric view of a pontoon boat with a container attached to its undersurface.

FIG. 3 is an isometric view of the underside of the pontoon boat 10 showing the position at which the container 30 is removably attached to the underside 32 of the deck of the pontoon boat 10. The container 30 is supported between the two flotation tubes, 14 and 15, and is removably attached to the underside 32 of the deck. One advantage of a preferred embodiment of the present invention is that it places the propulsor 66 at a position forward from a rear edge 68 of the deck. As such, it reduces the likelihood that swimmers will move to a position that is disadvantageously close to the propulsor 66. The location of the propulsor 66, as shown in FIG. 3, is also advantageous because it allows improved maneuverability of the pontoon boat 10. The step 60, which is formed in the bottom surface of the container 30, provides an improved upward thrust exerted on the deck of the pontoon boat 10 at a location which is more forward than would otherwise be the case if the step 60 was not provided.

Figure 4:
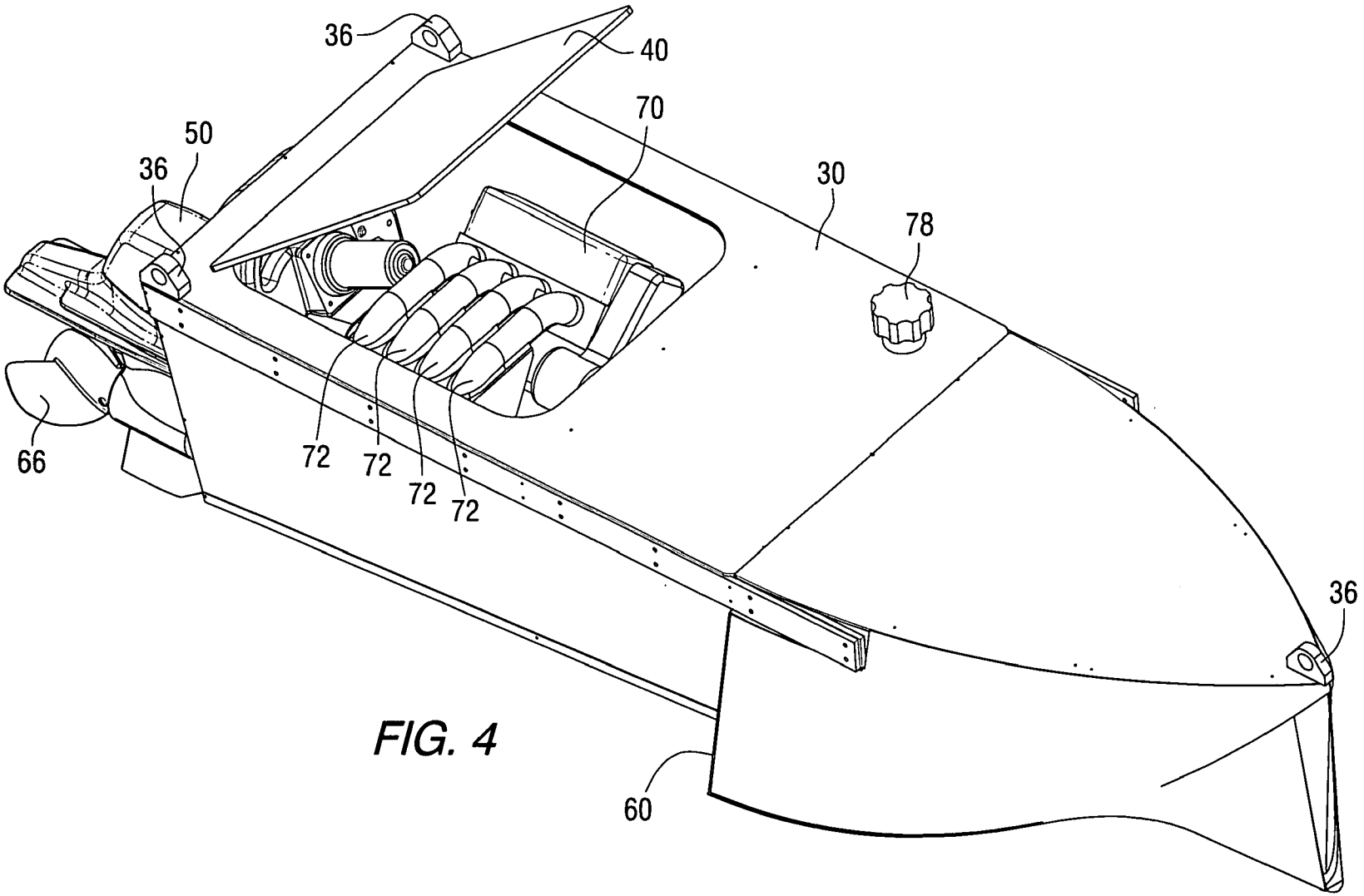
FIG. 4 is a container made in accordance with a preferred embodiment of the present invention.

FIG. 4 is an isometric view of the container 30. The container door 40 is partially opened to show the location of an internal combustion engine 70 which has four exhaust conduits 72 that direct exhaust gases from the engine 70 and direct those exhaust gases to an appropriate exhaust conduit which conducts the exhaust gases away from the container 30 and through the propulsor 66 of the sterndrive device 50. The conduction of exhaust gases from an engine of this type through a propeller of a sterndrive device is well known to those skilled in the art and will not be described in detail herein. The three mounting lugs 36 are shown attached to an upper surface of the container 30. These mounting lugs 36 are shaped to receive appropriate configured shafts or bolts which allow the container 30 to be removably attached to the underside of the deck of the pontoon boat. A fuel cap 78 is illustrated in FIG. 4. It is positioned to allow easy access of the fuel cap 78 through the fuel door 22 described above in conjunction with FIGS. 1 and 2. A fuel reservoir is located within the container 30 at the location below the position of the fuel cap 78 and its associated fuel conduit 42. A battery is also located within the container 30.

Figure 5:
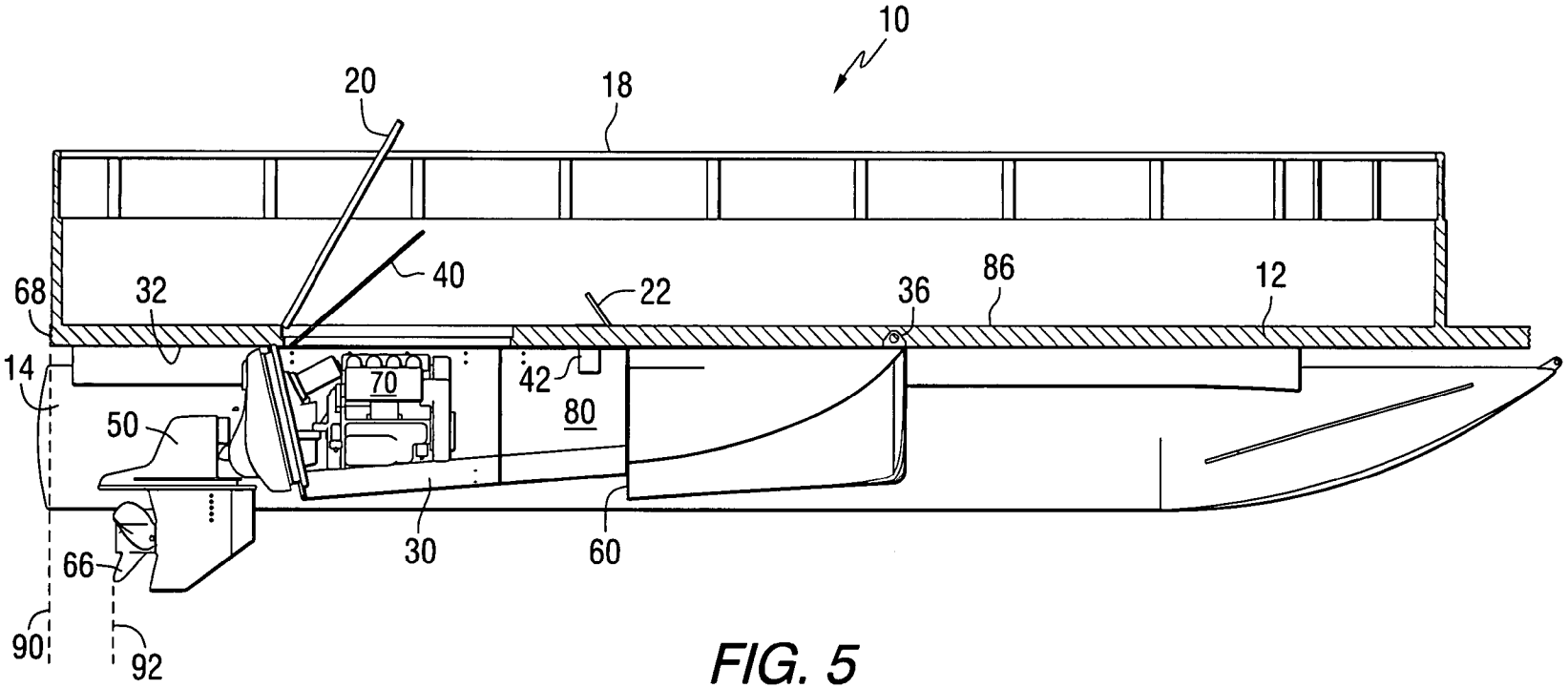
FIG. 5 is a side section view of a pontoon boat with a container attached to an underside of its deck and provided with a sterndrive propulsion device.

FIG. 5 is a side section view of a pontoon boat 10 with a preferred embodiment of the present invention attached to the underside 32 of the deck 12 of the pontoon boat. Both the deck door 20 and the container door 40 are shown partially open to illustrate their functionality. In addition, the fuel door 22 is shown partially opened to illustrate its position relative to the conduit 42 of the fuel reservoir 80 which is formed within the structure of the container 30. It should be understood that the fuel reservoir 80 can be a removable fuel container located in the space within the container 30 as an alternative configuration. The configuration shown in FIG. 5 incorporates a dedicated space within the container 30 as a volume into which fuel is stored for operation of the engine 70.

In the embodiment of the present invention shown in FIG. 5, the engine 70 has a crankshaft that is supported for rotation about a horizontal axis. That crankshaft is connected in torque transmitting relation with the driveshaft contained within the housing structure of the sterndrive device 50. The ways in which torque can be provided to a driveshaft of a sterndrive device 50 are well known to those skilled in the art of marine propulsion devices and will not be described herein.

With continued reference to FIG. 5, the removable attachment of the container 30 to the underside 32 of the deck 12, through the use of the mounts 36, places the engine 70 below the top surface 86 of the deck 12. This is significantly advantageous since it does not require the use of valuable space above the top surface 86. When the container door 40 is closed and the deck door 20 is closed above it, the present invention does not require any bulge that extends upwardly above the flat top surface 86. This leaves that space for use by the occupants of the pontoon boat 10.

With continued reference to FIG. 5, dashed lines 90 and 92 illustrate the spatial separation between the propeller 66 and the rear edge 68 of the deck 12. As discussed above, this spatial separation decreases the likelihood that a swimmer in the region of the pontoon boat 10 will move to a position that is disadvantageously close to the propeller 66.

Figure 6:
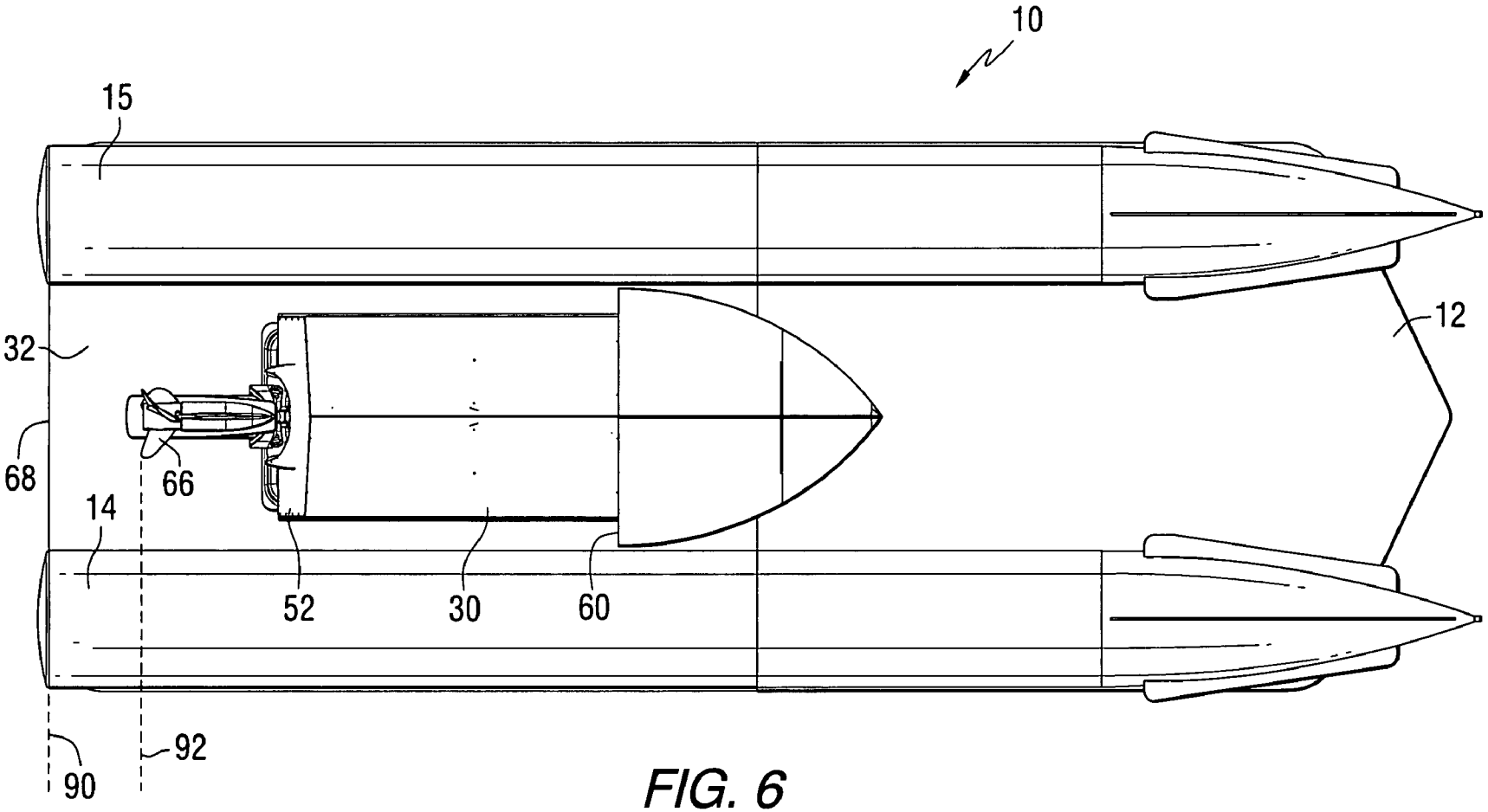
FIG. 6 is a bottom view of a pontoon boat with a self-contained propulsion system attached to an undersurface of its deck and spaced midway between two flotation tubes.

FIG. 6 is a bottom view of the pontoon boat showing the container 30 located between the flotation tubes, 14 and 15. In addition, it shows the position of the step 60 relative to the length of the pontoon boat 10 and the position of the propeller 66 relative to the rear edge 68 of the deck 12.

Figure 7:
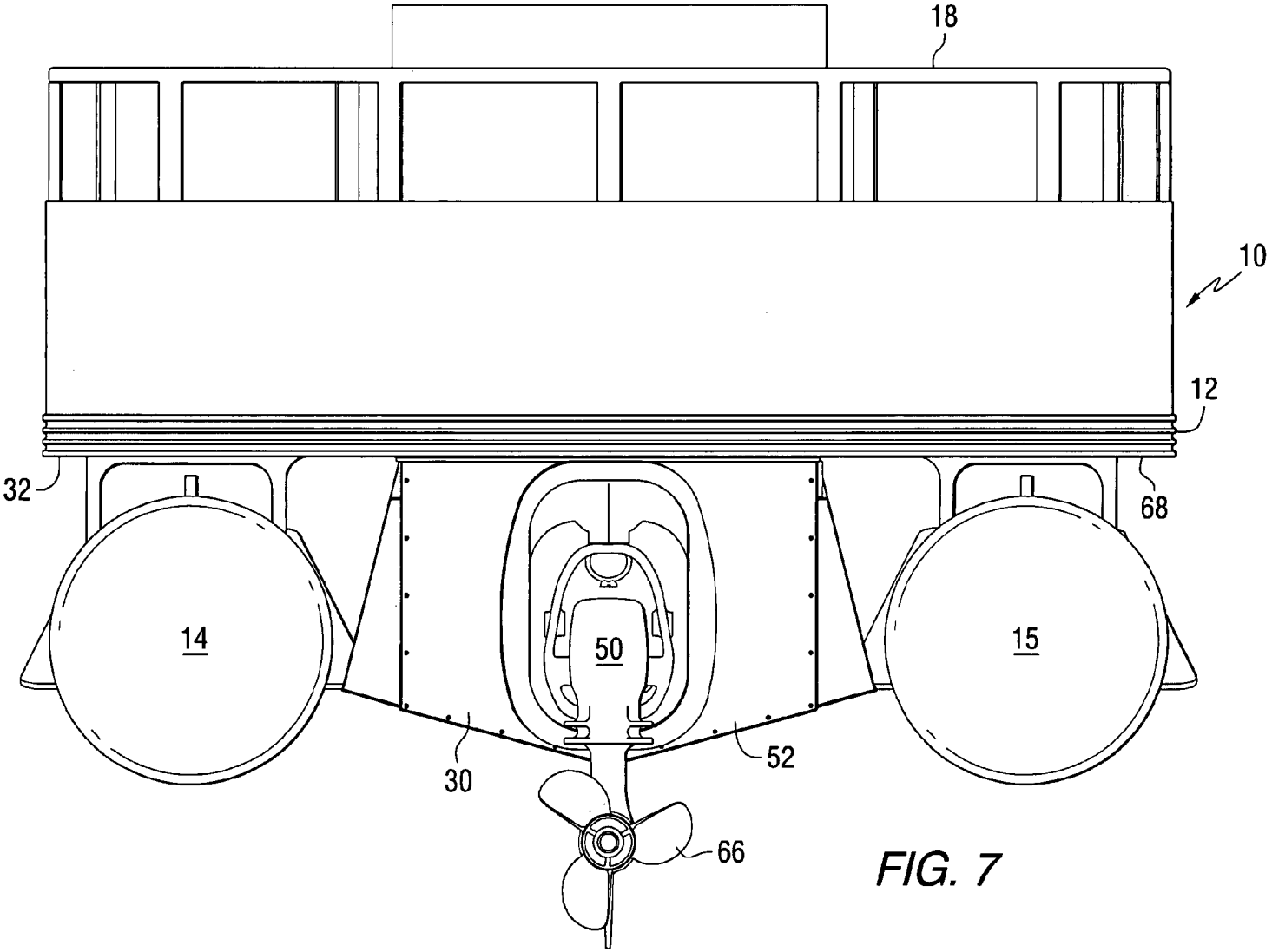
FIG. 7 is a rear view of a pontoon boat with a container supported under a deck of the pontoon boat and located midway between two flotation tubes.

FIG. 7 is a rear view of a pontoon boat 10 showing the position of the container between the flotation tubes, 14 and 15, and below the deck 12. The railing 18 is attached to the deck 12 in a manner that is generally well known to those skilled in the art.

Figure 8:
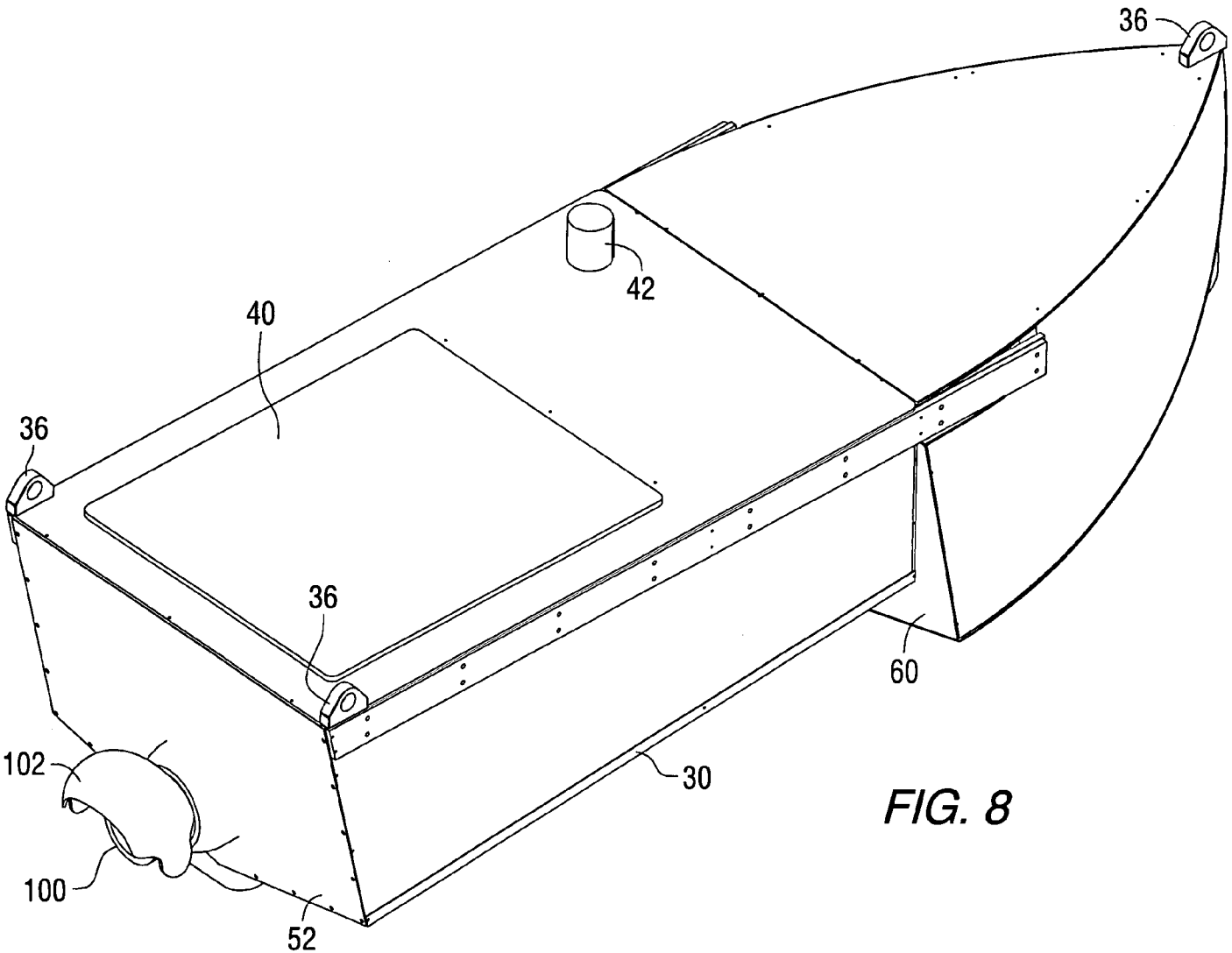
FIG. 8 shows an embodiment of the present invention which utilizes a jet drive attached to a container which is attachable to a deck of a pontoon boat.

FIG. 8 shows an embodiment of the present invention which is particularly advantageous in certain applications. By comparing FIGS. 4 and 8, it can be seen that the embodiment in FIG. 8 utilizes a jet drive propulsion device instead of the sterndrive system 50 described above. The jet drive propulsion device is indicated in FIG. 8 by the presence of a nozzle 100 and a reverse gate 102. Other than this distinction between FIGS. 4 and 8, the remaining components of the container 30 are similar to those described above in conjunction with FIG. 4. These include the mounts 36, the container door 40, the fuel conduit 42, and the step 60 in the outer hull of the container 30.

Figure 9:
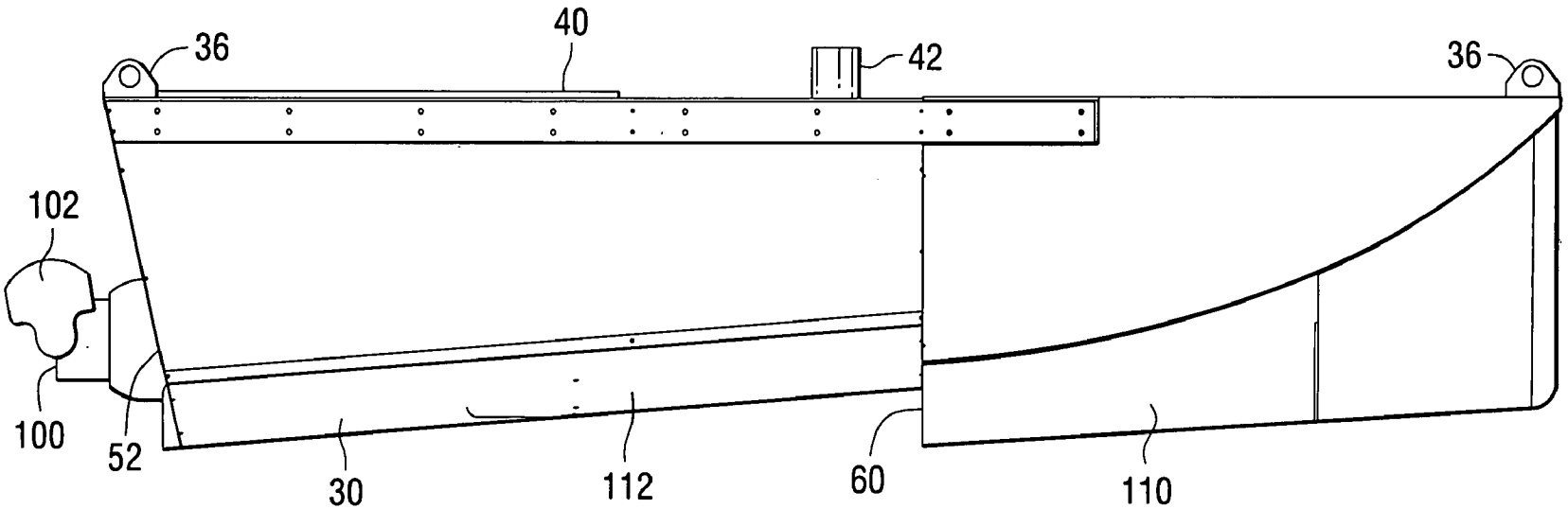
FIG. 9 is a side view of the container illustrated in FIG. 8.

FIG. 9 is a side view of a container 30 which is particularly adapted to support a jet drive propulsion device. The jet drive propulsion device, as indicated by the reverse gate 102 and nozzle 100, extends from the back surface 52 of the container 30. It is connected in torque transmitting association with an engine located within the container 30. The fuel conduit 42 is arranged to allow the operator of the pontoon boat to fill a fuel reservoir located within the container, as is described above. The container door 40 is shown in a closed position in FIG. 9. The step 60 separates a forward hull surface 110 from a rearward hull surface 112 of the container 30. This directs an upward force from the forward hull surface 110 at an advantageous location relative to the pontoon boat. In addition, it reduces an upwardly directed hydrodynamic force that might otherwise be exerted in the region of the rearward hull surface 112. This selective positioning of the upward hydrodynamic thrust can be advantageous if it is properly positioned relative to the center of gravity of the pontoon boat.

Figure 10:
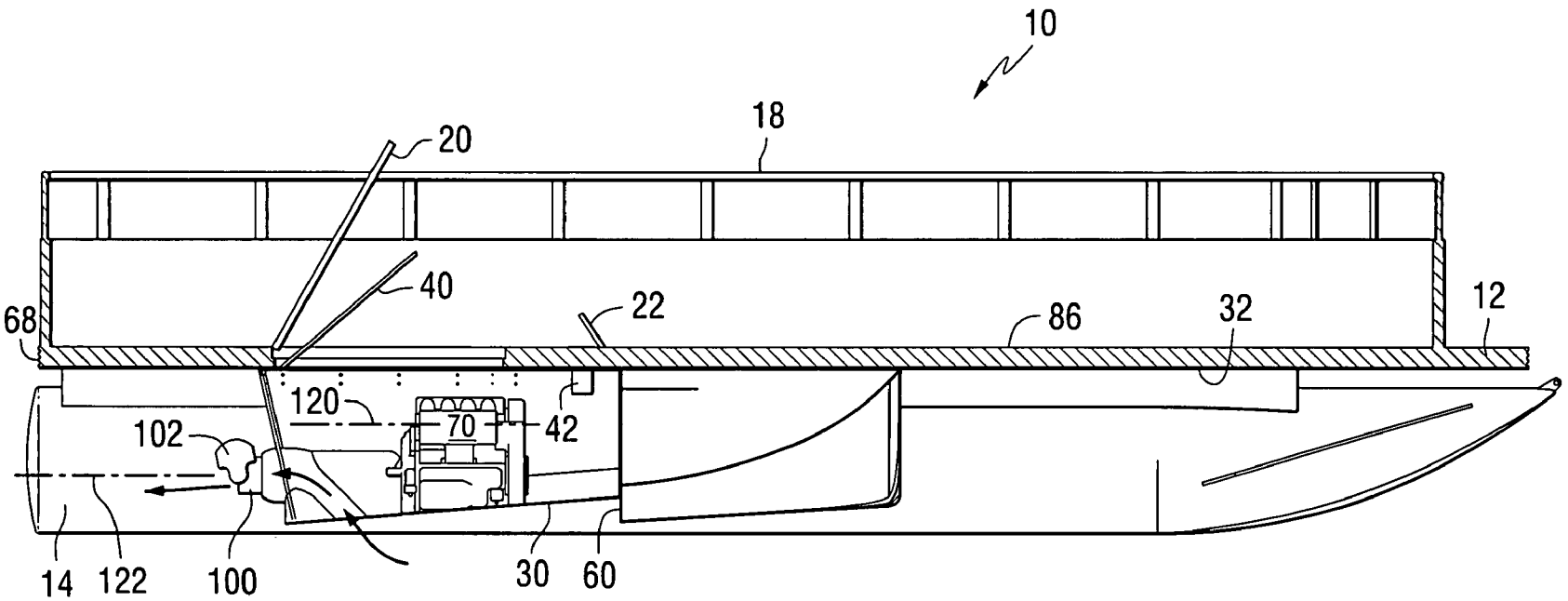
FIG. 10 is a side section view of an embodiment of the present invention in which a jet drive is associated with an engine having a horizontal crankshaft.

FIG. 10 is a side section view of a pontoon boat 10 having a jet drive propulsion system. FIGS. 5 and 10 are generally similar to each other, but with different types of marine propulsion systems. The embodiment of the present invention shown in FIG. 5 incorporates a sterndrive device 50. The embodiment of the present invention shown in FIG. 10 incorporates a jet drive system, represented by the reverse gate 102 and the nozzle 100. Those skilled in the art of marine propulsion devices are familiar with many different types of jet drive systems. They are also familiar with the fact that an impeller is supported for rotation about a generally horizontal axis. Although not shown in detail in FIG. 10, those skilled in the art of jet drive systems will appreciate that water is drawn upwardly through an inlet of the jet drive system and ejected in a reverse direction, as represented by the arrows in FIG. 10, to create a thrust that propels the vehicle, such as the pontoon boat 10, in a forward direction. When the reverse gate 110 is rotated into its downward position, the flow of water is caused to be redirected in a forward direction to create a rearward thrust on the pontoon boat 10.

Figure 11:
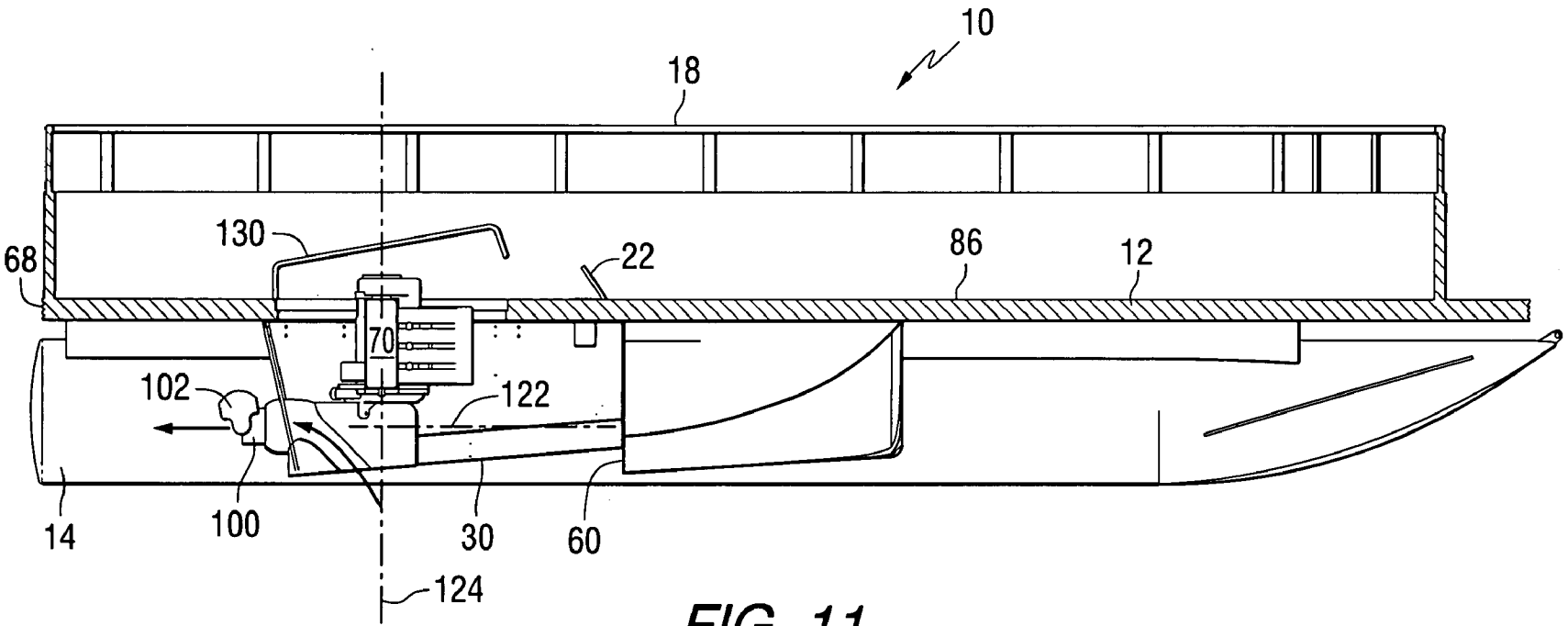
FIG. 11 is generally similar to FIG. 10, but with the engine being configured to support a crankshaft for rotation about a generally vertical axis.

The embodiment of the present invention shown in FIG. 10 incorporates an engine 70 that has a crankshaft supported for rotation about a generally horizontal axis 120. As will be discussed below, the present invention can also employ an engine 70 that has a crankshaft supported for rotation about a vertical axis 124. In the embodiment shown in FIG. 11, the impeller is supported for rotation about a generally horizontal axis. The primary difference between the embodiments shown in FIGS. 10 and 11 is that the engine 70 in FIG. 10 has a crankshaft that rotates about a generally horizontal axis 120, but the engine 70 in FIG. 11 has a crankshaft which rotates about a generally vertical axis 124. In both examples, the impeller of the jet drive device rotates about a generally horizontal axis 122. These variations are known to those skilled in the art and will not be further described herein.

The embodiment shown in FIG. 11, in certain applications, will require that the engine 70 extend upwardly above the top surface 86 of the deck 12. This can require that the system be provided with a deck door 130 that does not lie completely within the plane of the top surface 86 of the deck 12. Instead, the deck door 130, when closed, rises above the top surface 86 to accommodate the vertical dimension of the engine 70 when the embodiment of the present invention incorporates a crankshaft that rotates about a generally vertical axis 124. Other than this minor accommodation made to allow a vertical crankshaft engine 70 to be used, the other advantages of the present invention are incorporated in the embodiment shown in FIG. 11.

With reference to FIGS. 1–11, the present invention has been described in terms of several different embodiments. One embodiment uses a jet drive device. Those skilled in the art are familiar with the general operation of a jet drive device. In the patents described above, U.S. Pat. No. 4,051,801 illustrates one particular type of jet drive device and illustrates the basic operation of the reverse gate and nozzle which is steerable about a generally vertical steering axis. As a result, the embodiment of the present invention that utilizes a jet drive device is dirigible. Similarly, U.S. Pat. No. 5,879,209 also shows the position of an impeller supported for rotation about a horizontal axis and located forward from a nozzle and a reverse gate arrangement. U.S. Pat. No. 5,759,074 also shows an attachment system by which an impeller is attached to a shaft that is rotatable about a generally horizontal axis. U.S. Pat. No. 6,454,620 illustrates a sterndrive application associated with the transom of a marine vessel.

In the prior art associated with pontoon boats, it is known that a container can be attached to the deck of a pontoon boat with one or more propeller shafts of an inboard drive device extending in a rearward direction from the container. Each propeller shaft is provided with a propeller to provide a motive force for the pontoon boat. In devices of this type, an engine is disposed within the body of the container to provide torque for the one or more propeller shafts. It is also generally known that a sterndrive device can be attached to a container which is, in turn, attachable to the deck of a pontoon boat. However, the various embodiments of the present invention provide a system that differs from these known systems in several significant ways. For example, certain embodiments of the present invention incorporate a jet drive device that is rotatable relative to the engine which drives the impeller of the jet drive device. This is not the case when an outboard motor is equipped with a jet drive attached to the bottom portion of its driveshaft housing. In that type of known system, the engine of the outboard motor must be rotated about a steering axis and the jet drive itself does not rotate relative to that engine, but rotates with the engine and the other components of the outboard motor about the steering axis.

In the embodiments of the present invention that utilize a jet drive, the nozzle of the jet drive is dirigible and allows the device to be steered without having to move the engine relative to the pontoon boat. In addition, by locating the engine within the container which is removably attached to the underside of the deck, the nozzle and reverse gate of the jet drive device can be moved considerably forward from the rear edge of the deck. In embodiments of the present invention that incorporate a sterndrive device with the container, the entire system is able to be located below the top surface of the deck. That is not the case in systems known to those skilled in the art. As described above, many different types of attachment devices provide sponsons or flotation devices that can be used to exert an upward thrust on the pontoon boat. However, those devices are not also provided with the ability to contain an engine and support a marine propulsion device while also providing an upward hydrodynamic force. This is also true for those surfaces, as described in the patents above, that are attachable to the underside of the deck of a pontoon boat for purposes of creating hydrodynamic thrust in an upward direction.

Various embodiments of the present invention also provide access doors which can be located in the top surface of the deck and also in the upper surface of the container itself. This allows easy access to the engine compartment of the container so that routine maintenance and/or repair can be performed without removing the container from its attachment position under the deck of the pontoon boat.

Although the present invention has been described with particular specificity in relation to several embodiments and has been illustrated to show various views of those embodiments, it should be understood that alternative embodiments are also within its scope.

We claim:

1. A marine propulsion system for a pontoon boat, comprising:

a container;

an internal combustion engine disposed within said container; and a jet drive device connected in torque transmitting relation with said internal combustion engine, said marine propulsion device having a dirigible segment which is supported by said container for rotation about a steering axis relative to said internal combustion engine, said container being attachable to an underside of a platform of said pontoon boat with said internal combustion engine being disposed below a top surface of said platform.

2. The marine propulsion system of claim 1, wherein:

said internal combustion engine is disposed completely beneath an upper surface of said platform.

3. The marine propulsion system of claim 1, further comprising:

an elastomeric component disposed between said container and said underside of said platform of said pontoon boat.

4. The marine propulsion system of claim 1, wherein:

said container is removably attachable to said underside of said platform of said pontoon boat.

5. The marine propulsion system of claim 1, wherein:

said internal combustion engine is accessible, from above said internal combustion engine, through a door formed in said top surface of said platform.

6. The marine propulsion system of claim 1, wherein:

said top surface of said platform is a flat plane in the entire region directly above said container.

7. The marine propulsion system of claim 1, wherein:

said container is disposed between two flotation tubes of said pontoon boat.

8. The marine propulsion system of claim 1, further comprising:

a fuel reservoir disposed within said container and connected in fluid communication with said internal combustion engine.

9. The marine propulsion system of claim 8, wherein:

said fuel reservoir is removably disposable within said container.

10. The marine propulsion system of claim 1, further comprising:

an electrical storage battery disposed within said container and connected in electrical communication with a starter motor of said internal combustion engine.

11. The marine propulsion system of claim 1, wherein:

a crankshaft of said internal combustion engine is supported for rotation about a generally horizontal axis.

12. The marine propulsion system of claim 1, wherein:

a crankshaft of said internal combustion engine is supported for rotation about a generally vertical axis.

13. The marine propulsion system of claim 1, wherein:

said container is shaped to define a stepped hull surface.

14. The marine propulsion system of claim 1, wherein:

said container is shaped to define a hull having a discontinuous surface shaped to result in an upward force against said container at a forward portion of said container.

15. A marine propulsion system for a pontoon boat, comprising:

a container;

an internal combustion engine disposed within said container; and a jet drive device connected in torque transmitting relation with said internal combustion engine;

an impeller supported for rotation by said jet drive device, said jet drive device having a dirigible segment which is supported by said container for rotation about a steering axis relative to said internal combustion engine, said internal combustion engine being accessible, from above said internal combustion engine, through a door formed in said top surface of said platform, a top surface of said platform being a flat plane in the entire region directly above said container.

16. The marine propulsion system of claim 15, wherein:

said container is attachable to an underside of a platform of said pontoon boat with said internal combustion engine being disposed below a top surface of said platform, said internal combustion engine being disposed completely beneath an upper surface of said platform.

17. The marine propulsion system of claim 16, further comprising:

an elastomeric component disposed between said container and said underside of said platform of said pontoon boat.

18. The marine propulsion system of claim 17, wherein:

said container is removably attachable to said underside of said platform of said pontoon boat.

19. The marine propulsion system of claim 15, wherein:

said container is disposed between two flotation tubes of said pontoon boat.

20. The marine propulsion system of claim 15, further comprising:

a fuel reservoir disposed within said container and connected in fluid communication with said internal combustion engine.

21. The marine propulsion system of claim 20, wherein:

said fuel reservoir is removably disposable within said container.

22. The marine propulsion system of claim 15, wherein:

a crankshaft of said internal combustion engine is supported for rotation about a generally horizontal axis.

23. The marine propulsion system of claim 15, wherein:

a crankshaft of said internal combustion engine is supported for rotation about a generally vertical axis.

24. The marine propulsion system of claim 15, wherein:

said container is shaped to define a stepped hull surface.

25. The marine propulsion system of claim 15, wherein:

said container is shaped to define a hull having a discontinuous surface shaped to result in an upward force against said container at a forward portion of said container.

26. A marine propulsion system for a pontoon boat, comprising:

a container;

an internal combustion engine disposed within said container; and a jet drive device connected in torque transmitting relation with said internal combustion engine, said marine propulsion device having a dirigible segment which is supported by said container for rotation about a steering axis relative to said internal combustion engine, said container being removably attachable to an underside of a platform of said pontoon boat with said internal combustion engine being disposed below a top surface of said platform, said internal combustion engine being disposed completely beneath an upper surface of said platform.

27. The marine propulsion system of claim 26, wherein:

said internal combustion engine is accessible, from above said internal combustion engine, through a door formed in said top surface of said platform, said top surface of said platform being a flat plane in the entire region directly above said container.

28. The marine propulsion system of claim 26, further comprising:

a fuel reservoir disposed within said container and connected in fluid communication with said internal combustion engine.

29. The marine propulsion system of claim 28, wherein:

a crankshaft of said internal combustion engine is supported for rotation about a generally horizontal axis.

* * * * *